US012049380B2

(12) United States Patent
Arakawa et al.

(10) Patent No.: US 12,049,380 B2
(45) Date of Patent: Jul. 30, 2024

(54) IMAGE FORMING APPARATUS

(71) Applicant: BROTHER KOGYO KABUSHIKI KAISHA, Nagoya (JP)

(72) Inventors: Takashi Arakawa, Nagoya (JP); Kazuya Taira, Nagoya (JP); Kazushi Suzuki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 345 days.

(21) Appl. No.: 17/679,440

(22) Filed: Feb. 24, 2022

(65) Prior Publication Data

US 2022/0274796 A1 Sep. 1, 2022

(30) Foreign Application Priority Data

Feb. 26, 2021 (JP) ..... 2021-029421

(51) Int. Cl.
*B65H 7/14* (2006.01)
*B65H 5/06* (2006.01)

(52) U.S. Cl.
CPC ..... *B65H 7/14* (2013.01); *B65H 5/062* (2013.01)

(58) Field of Classification Search
CPC ..... B65H 85/00; B65H 7/14; B65H 5/062; B65H 2553/412; G03G 15/80
See application file for complete search history.

(56) References Cited

U.S. PATENT DOCUMENTS 4,958,828 A * 9/1990 Saito ..... G03G 15/23 271/902
9,475,664 B2 * 10/2016 Yonemoto ..... B65H 7/02
9,950,887 B2 * 4/2018 Koyama ..... B65H 5/062
10,942,481 B2 * 3/2021 Hamasaki ..... G03G 15/6547
2013/0026705 A1 * 1/2013 Masuda ..... B65H 5/38 271/225
2018/0273327 A1 * 9/2018 Fujioka ..... B65H 1/04
2018/0335752 A1 11/2018 Saeki et al.
2019/0094784 A1 3/2019 Hamasaki
2020/0207566 A1 7/2020 Tatematsu et al.

FOREIGN PATENT DOCUMENTS

JP 5-68992 U 9/1993
JP 2009122518 A * 6/2009
JP 2013-50698 A 3/2013
JP 2018-194660 A 12/2018
JP 2019-66826 A 4/2019
JP 2020-106701 A 7/2020

* cited by examiner

*Primary Examiner* — Howard J Sanders
(74) *Attorney, Agent, or Firm* — Merchant & Gould P.C.

(57) ABSTRACT

A first detector detects a sheet between a first conveyance roller and a confluence position in a conveyance path. The first detector includes a first actuator and a first sensor. The first actuator is rotationally movable by contacting the sheet conveyed by the first conveyance roller. The first sensor is an optical sensor that detects rotational movement of the first actuator. A second detector detects the sheet between a second conveyance roller and the confluence position in a reconveyance path. The second detector includes a second actuator and a second sensor. The second actuator is rotationally movable by contacting the sheet conveyed by the second conveyance roller. The second sensor is an optical sensor that detects rotational movement of the second actuator. A single sensor board supports the first sensor and the second sensor. The sensor board has a wiring pattern connected to the first sensor and the second sensor.

16 Claims, 12 Drawing Sheets

IMAGE FORMING APPARATUS

CROSS REFERENCE TO RELATED APPLICATIONS

This application claims priority from Japanese Patent Application No. 2021-029421 filed Feb. 26, 2021. The entire content of the priority application is incorporated herein by reference.

BACKGROUND

An image forming apparatus includes an image forming unit, a conveyance path, a reconveyance path, conveyance rollers, and a registration roller. The image forming unit forms an image on a sheet. The conveyance path is a path for conveying the sheet toward the image forming unit. The reconveyance path is a path for conveying a sheet having an image formed on one surface toward the image forming unit again. The reconveyance path joins the conveyance path at a confluence position.

SUMMARY

According to one aspect, this specification discloses an image forming apparatus. The image forming apparatus includes an apparatus main body, a print engine, a first conveyance roller, a second conveyance roller, a third conveyance roller, a first detector, a second detector, and a single sensor board. A conveyance path and a reconveyance path are formed in the apparatus main body. The print engine is configured to form an image on a sheet. The conveyance path is a path for conveying a sheet toward the print engine. The reconveyance path is a path for again conveying the sheet on which an image is formed on one surface toward the print engine. The reconveyance path joins the conveyance path at a confluence position. The first conveyance roller is configured to convey the sheet toward the confluence position in the conveyance path. The second conveyance roller is configured to convey the sheet toward the confluence position in the reconveyance path. The third conveyance roller is located between the confluence position and the print engine in the conveyance path. The third conveyance roller is configured to convey the sheet toward the print engine. The first detector is configured to detect the sheet between the first conveyance roller and the confluence position in the conveyance path. The first detector includes a first actuator and a first sensor. The first actuator is rotationally movable by contacting the sheet conveyed by the first conveyance roller. The first sensor is an optical sensor configured to detect rotational movement of the first actuator. The second detector is configured to detect the sheet between the second conveyance roller and the confluence position in the reconveyance path. The second detector includes a second actuator and a second sensor. The second actuator is rotationally movable by contacting the sheet conveyed by the second conveyance roller. The second sensor is an optical sensor configured to detect rotational movement of the second actuator. The single sensor board supports the first sensor and the second sensor. The sensor board has a wiring pattern connected to the first sensor and the second sensor.

The above image forming apparatus realizes a common board for the first sensor and the second sensor by using the single sensor board. As a result, the image forming apparatus does not need to separately provide a sensor board that supports the first sensor and a sensor board that supports the second sensor, and there is no need to separately secure spaces for installing the sensor boards.

Thus, the image forming apparatus realizes downsizing and reduction of manufacturing cost.

BRIEF DESCRIPTION OF THE DRAWINGS

Embodiments in accordance with this disclosure will be described in detail with reference to the following figures wherein.

DETAILED DESCRIPTION

A conveyance roller conveys a sheet toward a confluence position in a conveyance path. Another conveyance roller conveys a sheet toward the confluence position in a reconveyance path. A registration roller is located between the confluence position and an image forming unit in the conveyance path, and conveys the sheet toward the image forming unit.

An image forming apparatus generally includes a first detector that detects a sheet between the conveyance roller and the confluence position in the conveyance path. The first detector has an actuator that contacts the conveyed sheet and rotationally moves, and an optical sensor that detects the rotational movement of the actuator.

By adding, to the image forming apparatus, a second detector that detects the sheet between the conveyance roller and the confluence position in the reconveyance path, the conveyance timing is suitably controlled for each of the sheet that is conveyed along the conveyance path and the sheet that is conveyed along the reconveyance path.

However, by adding the second detector, the image forming apparatus requires an actuator and an optical sensor as in the first detector, and further requires a sensor board that supports the sensor of the first detector, a sensor board that supports the sensor of the second detector, and spaces for installing those sensor boards. Thus, it may be difficult to reduce the size and manufacturing cost of the image forming apparatus.

In view of the foregoing, an aspect of an object of this disclosure is to provide an image forming apparatus configured to realize reduction of the size and manufacturing cost.

Hereinafter, an aspect of this disclosure will be described with reference to the accompanying drawings.

Figure 1:
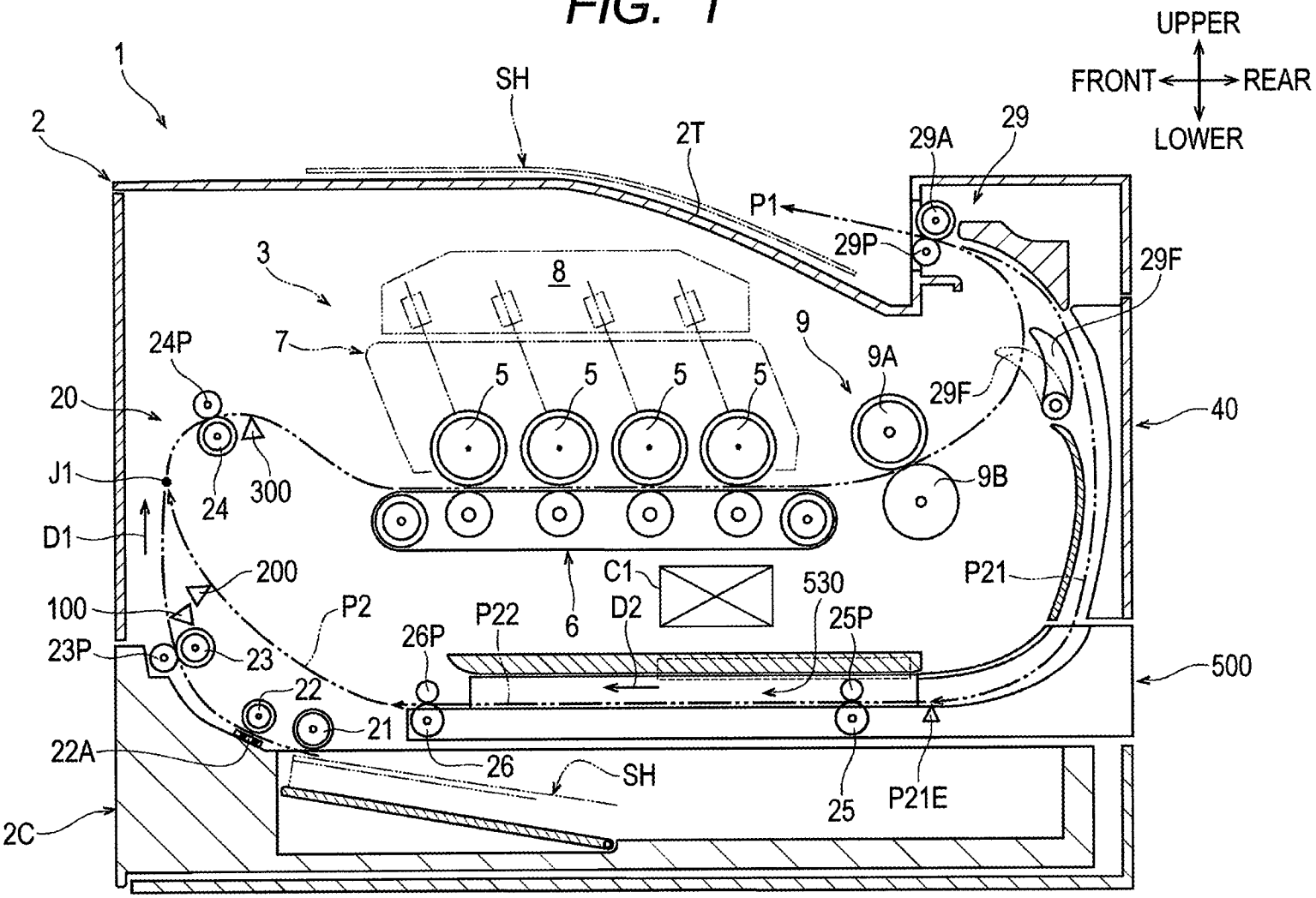
FIG. 1 is a schematic cross-sectional view showing an image forming apparatus.

As shown in FIG. 1, an image forming apparatus 1 of an embodiment is an example of an image forming apparatus of this disclosure. The image forming apparatus 1 is a laser printer that forms an image on a sheet SH by an electrophotographic method.

In FIG. 1, the left side of the drawing surface is defined as the front of the image forming apparatus 1, and the upper side of the drawing surface is defined as the upper side of the image forming apparatus 1. Each direction shown in FIG. 2 and thereafter is shown in accordance with FIG. 1.

<Overall Configuration of Image Forming Apparatus>

As shown in FIG. 1, the image forming apparatus 1 includes an apparatus main body 2, a sheet tray 2C, a controller C1, a supply unit 20, an image forming unit (print engine) 3, a discharge unit 29, and a reconveyance tray 500.

The apparatus main body 2 is substantially a box-shaped body, and the sheet tray 2C is detachably accommodated at the bottom thereof. The sheet tray 2C accommodates the sheet SH before being conveyed by the supply unit 20 in a stacked state. The sheet SH is a paper, an OHP sheet, and so on.

The apparatus main body 2 includes a discharge tray 2T. The discharge tray 2T is located at the upper surface of the apparatus main body 2. The discharge tray 2T supports the sheet SH for which image formation is finished. The apparatus main body 2 further includes a rear cover 40. The rear cover 40 constitutes a part of the rear surface of the apparatus main body 2.

The controller C1 includes a calculation unit mainly composed of a CPU, a ROM, and a RAM (not shown), and hardware for controlling a semiconductor laser, a motor, and so on. The ROM stores a program for the CPU to control various operations of the image forming apparatus 1, a program for executing an identification process, and so on. The RAM functions as a storage area for temporarily storing data and signals used by the CPU when executing the program, or as a work area for data processing.

The controller C1 controls the entire image forming apparatus 1 including the supply unit 20, the image forming unit 3, the discharge unit 29, and the reconveyance tray 500.

The supply unit 20, the image forming unit 3, and the discharge unit 29 are located above the sheet tray 2C in the apparatus main body 2. The reconveyance tray 500 is located below the image forming unit 3 and above the sheet tray 2C in the apparatus main body 2.

In the image forming apparatus 1, a conveyance path P1 and a reconveyance path P2 are formed in the main housing 2.

The conveyance path P1 is a path for conveying the sheet SH accommodated in the sheet tray 2C toward the image forming unit 3.

More specifically, the conveyance path P1 passes through the supply unit 20 while making an upward U-turn from the front end of the sheet tray 2C, passes through the image forming unit 3 substantially horizontally rearward, and further makes an upward U-turn to reach the discharge tray 2T through the discharge unit 29. The conveyance direction of the sheet SH conveyed along the conveyance path P1 is referred to as a conveyance direction D1.

The reconveyance path P2 is a path for reversing the sheet SH for which an image is formed on one surface by the image forming unit 3 and conveying the same toward the image forming unit 3 again. The reconveyance path P2 joins the conveyance path P1 at a confluence position J1.

More specifically, the reconveyance path P2 extends downward from the discharge unit 29, changes its direction at a position below the image forming unit 3 and above the sheet tray 2C, extends substantially horizontally forward through the reconveyance tray 500, and then joins the conveyance path P1 at the confluence position J1 and reaches the supply unit 20. The reconveyance direction of the sheet SH conveyed along the reconveying path P2 is referred to as a reconveyance direction D2.

The reconveyance path P2 has a curved section P21 and a horizontal section P22.

In the curved section P21, the reconveyance direction D2 of the sheet SH conveyed along the reconveyance path P2 changes from a downward direction to a horizontal direction toward the confluence position J1.

The horizontal section P22 is connected to a downstream end P21E of the curved section P21 in the reconveyance direction D2. In the horizontal section P22, the reconveyance direction D2 is a horizontal direction toward the confluence position J1.

The reconveyance path P2 extends to be inclined forward and upward at the downstream side of the horizontal section P22 in the reconveyance direction D2, and reaches the confluence position J1.

Figure 2:
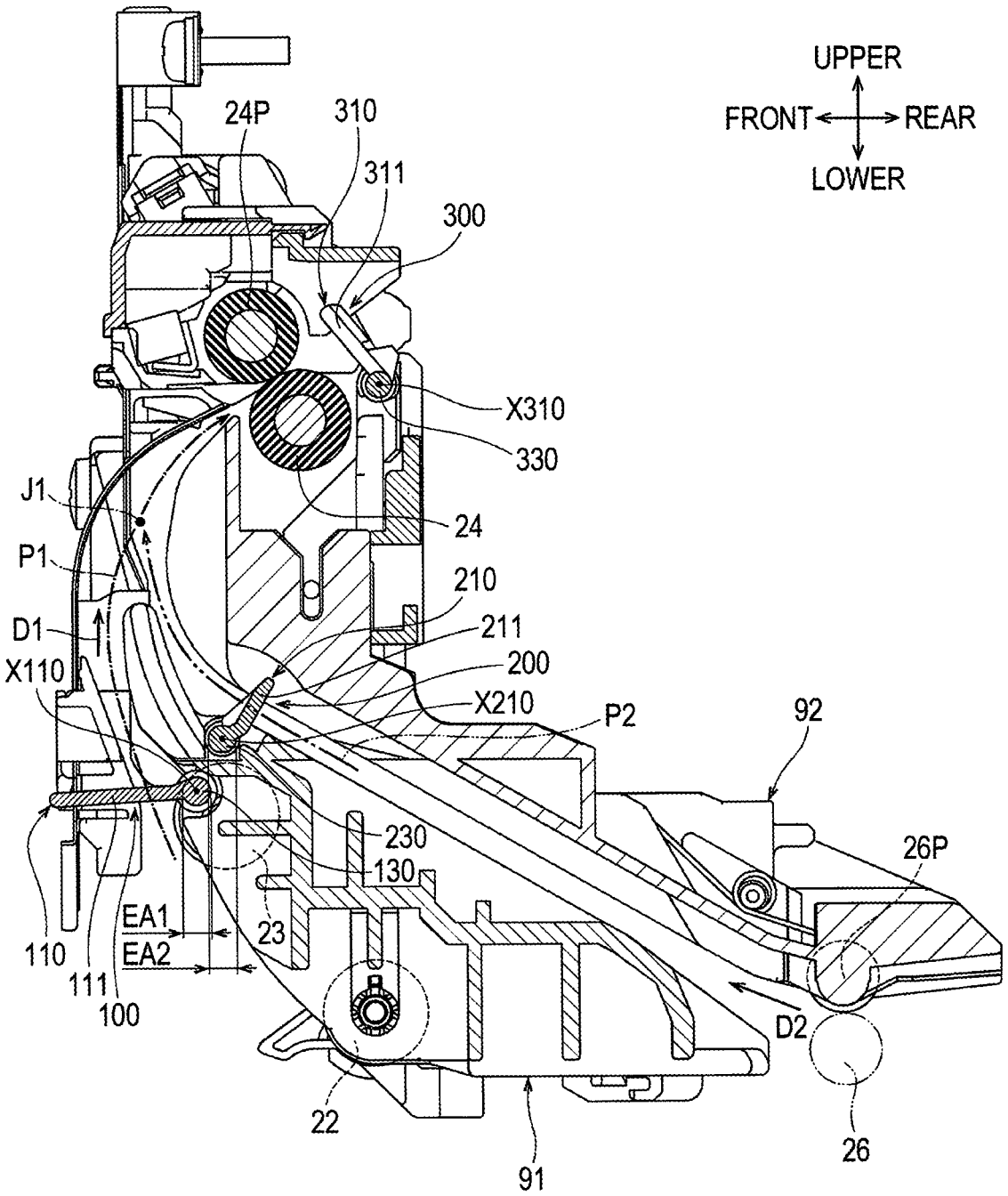
FIG. 2 is a partial cross-sectional view mainly showing first and second frames and first to third actuators.
Figure 3:
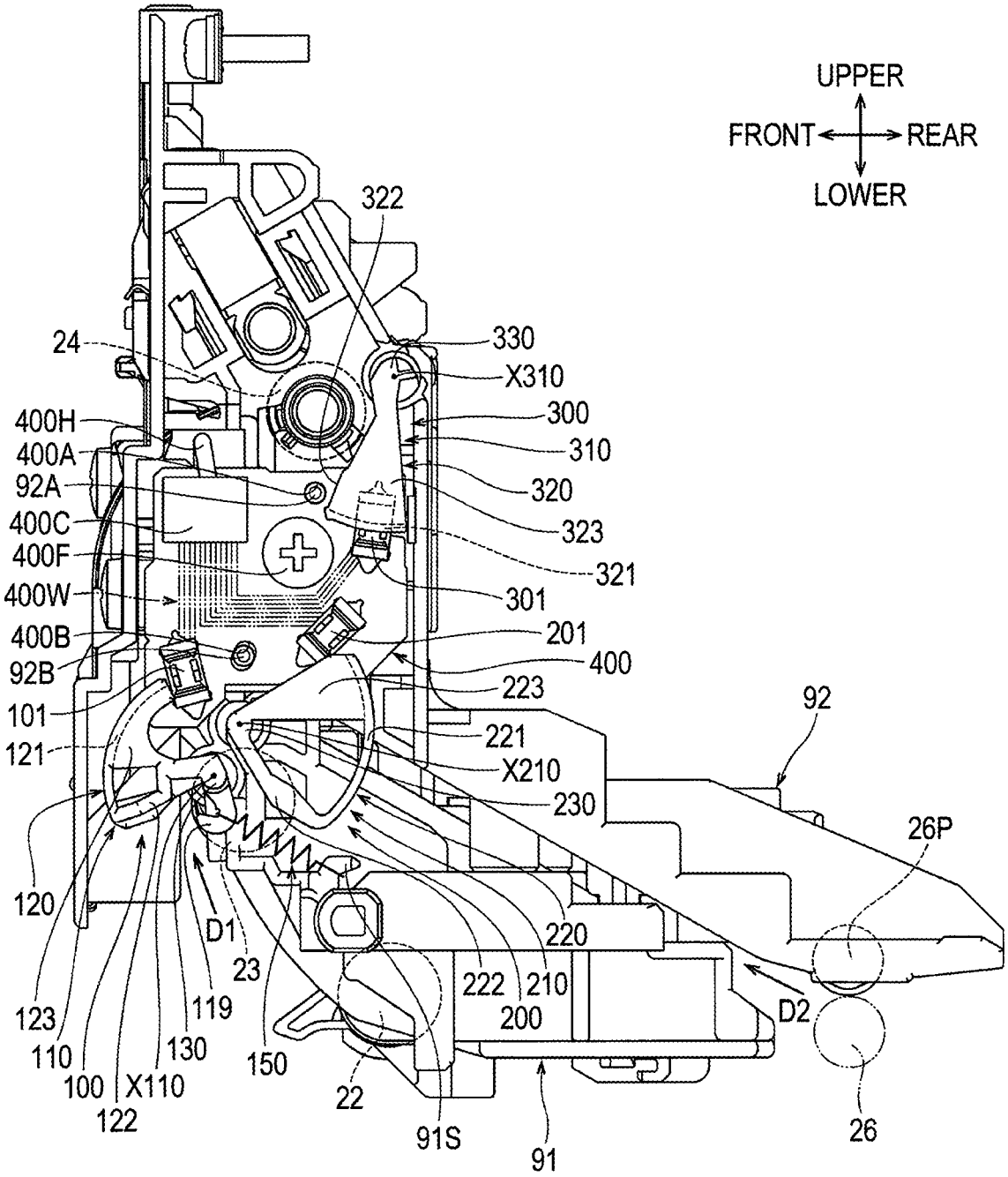
FIG. 3 is a partial side view mainly showing the first and second frames, the first to third actuators, first to third sensors, and a sensor board.

The width direction of the sheet SH conveyed along the conveyance path P1 and the reconveyance path P2 is a direction perpendicular to the front-rear direction and the upper-lower direction (vertical direction), and is a direction perpendicular to the drawing surface of FIGS. 1 to 3. The near side in the direction perpendicular to the drawing surface of FIGS. 1 to 3 is referred to as one side in the width direction, and the width direction is shown appropriately in FIG. 4 and thereafter.

As shown in FIG. 1, the supply unit 20 includes a supply roller 21, a separation roller 22, and a separation pad 22A. The supply roller 21 is located at an upstream end of the conveyance path P1 in the conveyance direction D1. The supply roller 21 sends out the sheet SH accommodated in the sheet tray 2C to the conveyance path P1. The separation roller 22 and the separation pad 22A separate one sheet at a time when a plurality of sheets SH are sent out by the supply roller 21.

The supply unit 20 includes a conveyance roller 23, a pinch roller 23P, a registration roller 24, and a pinch roller 24P. The conveyance roller 23 is an example of "first conveyance roller". The registration roller 24 is an example of "third conveyance roller".

The conveyance roller 23 is located between the separation roller 22 and the confluence position J1 in the conveyance path P1. The pinch roller 23P is pressed toward the conveyance roller 23. The conveyance roller 23 cooperates with the pinch roller 23P to convey the sheet SH toward the confluence position J1 in the conveyance path P1.

The registration roller 24 is located between the confluence position J1 and the image forming unit 3 in the conveyance path P1. The pinch roller 24P is pressed toward the registration roller 24. The registration roller 24 cooperates with the pinch roller 24P to convey the sheet SH toward the image forming unit 3 in the conveyance path P1.

The image forming unit 3 is a direct-transfer-type color electrophotographic system. The image forming unit 3 includes a process cartridge 7, a transfer belt 6, a scanner unit 8, a fixing device 9, and so on, which are well-known configurations.

The process cartridge 7 corresponds to toner of four colors of black, yellow, magenta, and cyan, and is a set of four cartridges arranged in series along a substantially horizontal portion of the conveyance path P1. The process cartridge 7 has four photosensitive members 5, development rollers (not shown), chargers, toner storage portions, and so on, corresponding to toner of each color. The direction in which an axis of each photosensitive member 5 extends is the width direction.

The transfer belt 6 faces each photosensitive member 5 from below. The transfer belt 6 circulates while sandwiching the sheet SH conveyed from the sheet tray 2C together with each photosensitive member 5.

The scanner unit 8 includes a laser light source, a polygon mirror, an fθ lens, a reflecting mirror, and so on. The scanner unit 8 irradiates each photosensitive member 5 in the process cartridge 7 with a laser beam from above.

The fixing device 9 is located at the rear side of the process cartridge 7. The fixing device 9 includes a heating roller 9A and a pressure roller 9B. The fixing device 9 heats and pressurizes the sheet SH that has passed below the process cartridge 7 by the heating roller 9A and the pressure roller 9B.

The image forming unit 3 forms an image on the sheet SH conveyed along the conveyance path P1 as follows. That is, the surface of each photosensitive member 5 is uniformly positively charged by the charger while rotating, and then exposed by high-speed scanning of the laser beam emitted from the scanner unit 8. With this operation, an electrostatic latent image corresponding to the image to be formed on the sheet SH is formed on the surface of each photosensitive member 5. Next, toner is supplied from the toner storage portion to the surface of each photosensitive member 5 corresponding to the electrostatic latent image. Then, when the sheet SH is conveyed along the conveyance path P1 and passes through the image forming unit 3, one surface of the sheet SH faces upward and faces the photosensitive member 5. Then, the toner borne on the surface of each photosensitive member 5 is transferred to one surface of the sheet SH, and is heated and pressed by the fixing device 9. As a result, the toner is fixed on the sheet SH.

The discharge unit 29 includes a discharge roller 29A, a pinch roller 29P, and a flapper 29F.

The discharge roller 29A is located at the most downstream side in the conveyance path P1. The pinch roller 29P is pressed toward the discharge roller 29A. The discharge roller 29A is controlled by the controller C1 to rotate forward and reversely.

The flapper 29F is located at a portion of the conveyance path P1 that makes an upward U-turn at the rear side of the fixing device 9. The flapper 29F is swingable between the position shown by the solid line in FIG. 1 and the position shown by the double-dot chain line in FIG. 1.

The flapper 29F is held by a spring (not shown) at the position shown by the double-dot chain line in FIG. 1. The urging force of this spring is weak enough to an extent that, when the sheet SH conveyed along the conveyance path P1 contacts the flapper 29F, the flapper 29F swings to the position shown by the solid line in FIG. 1.

When performing an image forming operation on only one surface of the sheet SH, the discharge roller 29A cooperates with the pinch roller 29P and rotates in a forward direction while sandwiching the sheet SH that has passed through the fixing device 9, thereby discharging the sheet SH to the discharge tray 2T. At this time, the flapper 29F is pushed by the sheet SH and swings to the position shown by the solid line in FIG. 1, and after the sheet SH passes, returns to the position shown by the double-dot chain line in FIG. 1.

When performing an image forming operation on both surfaces of the sheet SH, the discharge roller 29A, the pinch roller 29P, and the flapper 29F function as a reversing mechanism of the sheet SH, and reverse the sheet SH on which an image is formed on one surface.

That is, in a middle of a process that the discharge roller 29A and the pinch roller 29P sandwich the sheet SH and discharge the sheet SH toward the discharge tray 2T, the controller C1 switches the discharge roller 29A from the forward rotation to the reverse rotation at a particular timing after a sheet sensor (not shown) detects the trailing edge of the sheet SH passing through the fixing device 9. As a result, the discharge roller 29A and the pinch roller 29P reverse the sheet SH.

The particular timing is set to a timing after the trailing edge of the sheet SH passes through the flapper 29F and the flapper 29F returns to the position shown by the double-dot chain line in FIG. 1. In the state where the flapper 29F is in the position shown by the double-dot chain line in FIG. 1, the upper end of the flapper 29F crosses the conveyance path P1 and the flapper 29F extends along the reconveyance path P2. Thus, the flapper 29F guides the reversed sheet SH to the reconveyance path P2.

The reconveyance tray 500 includes a regulating member 530, a first reconveyance roller 25, an oblique conveyance roller 25P, a second reconveyance roller 26, and a pinch roller 26P. The second reconveyance roller 26 is an example of the "second conveyance roller".

The regulating member 530 is located in the horizontal section P22 of the reconveyance path P2 and is located at the other side in the width direction. The regulating member 530 is for aligning the sheet SH in the width direction. The regulating member 530 has a regulating surface 530A. The regulating surface 530A is a surface extending in the front-rear direction and in the upper-lower direction. The regulating surface 530A is configured to contact an end of the sheet SH in the width direction (the left-right direction).

The first reconveyance roller 25 is located near the downstream end P21E of the curved section P21 in the horizontal section P22 of the reconveyance path P2. The oblique conveyance roller 25P is pressed toward the first reconveyance roller 25. The first reconveyance roller 25 cooperates with the oblique conveyance roller 25P to convey the sheet SH toward the second reconveyance roller 26 in the reconveyance path P2. At this time, the oblique conveyance roller 25P obliquely conveys the sheet SH toward the regulating member 530.

The second reconveyance roller 26 is located at the most downstream side of the horizontal section P22 of the reconveyance path P2. The pinch roller 26P is pressed toward the second reconveyance roller 26. The second reconveyance roller 26 cooperates with the pinch roller 26P to convey the sheet SH toward the confluence position J1 in the reconveyance path P2.

As a result, the reconveyed sheet SH joins the conveyance path P1 at the confluence position J1. The image forming unit 3 forms an image on the other surface of the reconveyed sheet SH, and the discharge unit 29 discharges the sheet SH for which images are formed on both surfaces to the discharge tray 2T.

<First Frame and Second Frame>

Figure 4:
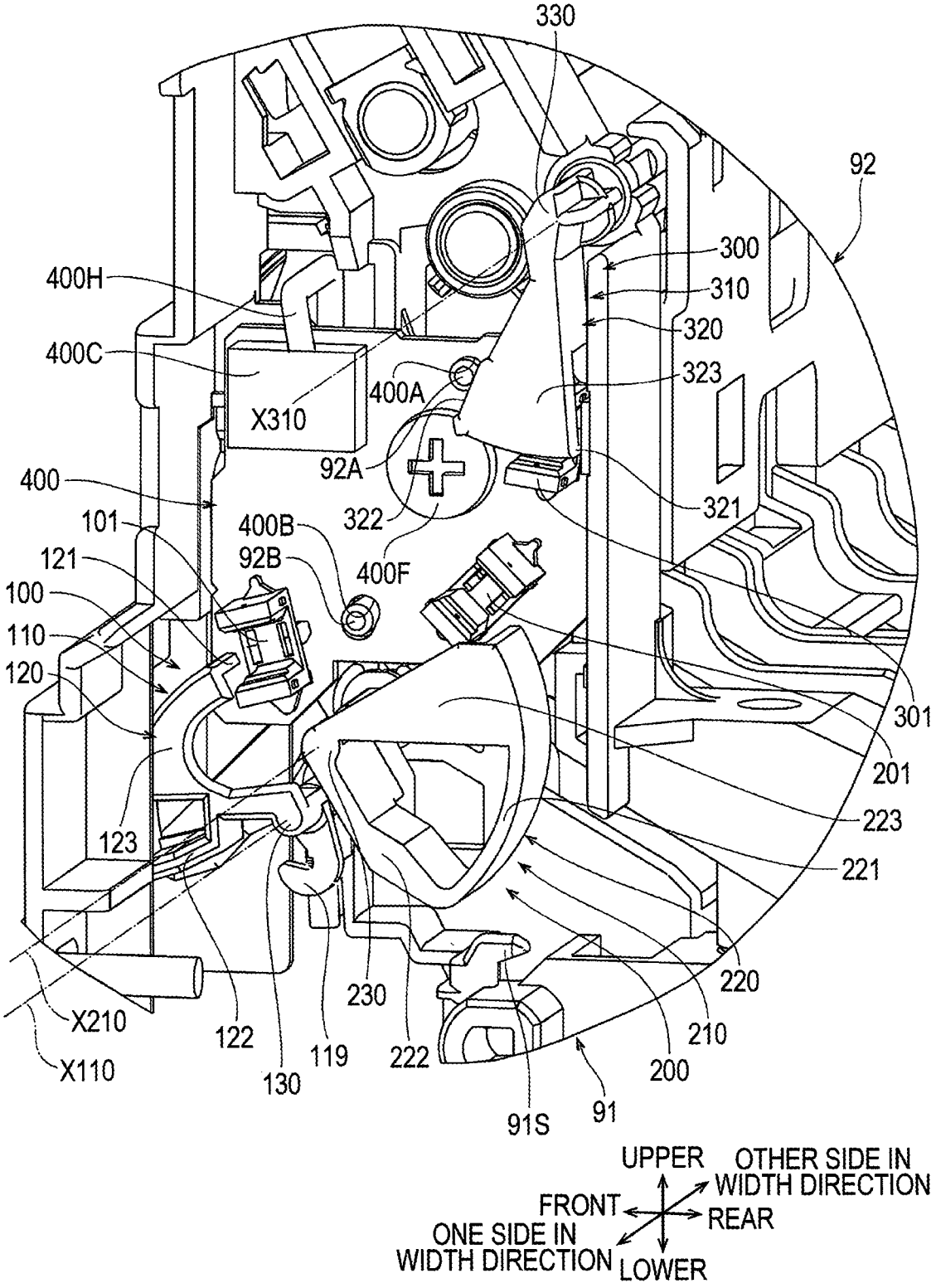
FIG. 4 is a partial perspective view mainly showing the first and second frames, the first to third actuators, the first to third sensors, and the sensor board.

As shown in FIG. 2 to FIG. 4, the image forming apparatus 1 includes a first frame 91 and a second frame 92.

The first frame 91 and the second frame 92 are resin molded components produced of thermoplastic resin by injection molding and so on.

Although not shown in the drawing, the first frame 91 and the second frame 92 are coupled to each other by fastening with screws in a state where the first frame 91 and the second frame 92 are positioned with high accuracy by fitting parts, engaging parts and so on, at positions at the one side and the other side in the width direction with respect to the conveyance path P1 and the reconveyance path P2.

As shown in FIG. 2, the first frame 91 and the second frame 92 define a part of the conveyance path P1 and a part of the reconveyance path P2.

More specifically, the surface of the first frame 91 facing forward and downward defines a portion extending from the most upstream side of the conveyance path P1 in the conveyance direction D1 to the confluence position J1.

The surface of the first frame 91 facing upward and rearward and the surface of the second frame 92 facing forward and downward define a portion of the reconveyance path P2 which is inclined forward and upward and reaches the confluence position J1.

The surface of the second frame 92 facing upward and forward defines a portion of the conveyance path P1 extending from the confluence position J1 toward the image forming unit 3.

The first frame 91 rotatably supports the separation roller 22 and the conveyance roller 23. The second frame 92 rotatably supports the registration roller 24 and the pinch roller 26P.

<Single Sensor Board>

Figure 6:
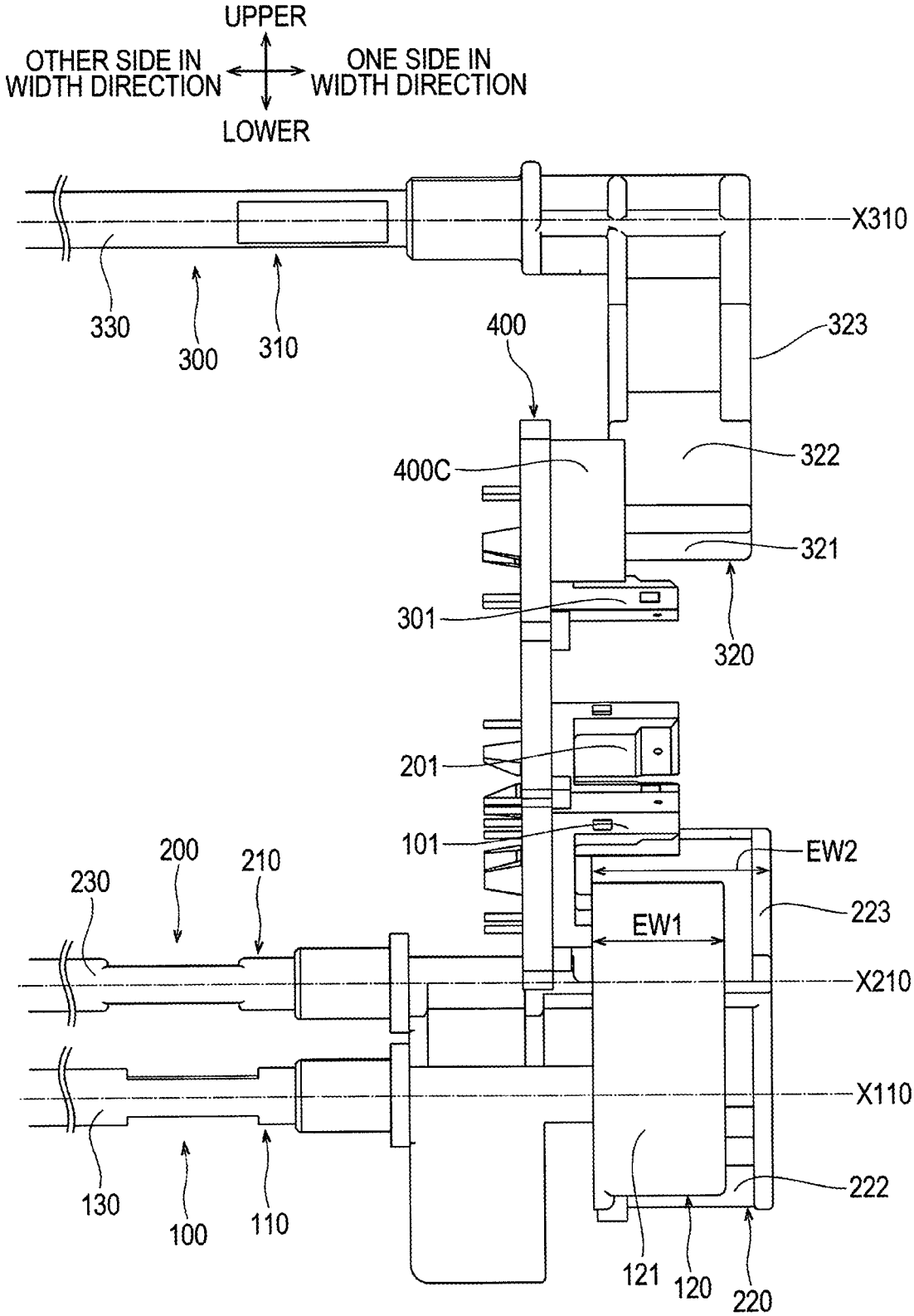
FIG. 6 is a partial front view showing the first to third actuators, the first to third sensors, and the sensor board.

As shown in FIG. 3, FIG. 4 and FIG. 6, the image forming apparatus 1 includes a single sensor board 400. The sensor board 400 is a small-sized printed board.

As shown in FIG. 3 and FIG. 4, the sensor board 400 has a first positioning hole 400A and a second positioning hole 400B. The first positioning hole 400A is a circular hole located at the upper side of the sensor board 400. The second positioning hole 400B is a long hole located at the lower side of the sensor board 400.

The second frame 92 has a first positioning protrusion 92A and a second positioning protrusion 92B. Each of the first positioning protrusion 92A and the second positioning protrusion 92B is a cylindrical protrusion protruding from the surface of the one side in the width direction of the second frame 92 toward the one side in the width direction. The second positioning protrusion 92B is located below the first positioning protrusion 92A.

The first positioning protrusion 92A is inserted into the first positioning hole 400A, and the second positioning protrusion 92B is inserted into the second positioning hole 400B. This allows to position the sensor board 400 with high accuracy relative to the second frame 92 in a state where the sensor board 400 is located at the one side in the width direction with respect to the conveyance path P1 and the reconveyance path P2.

A screw 400F is screwed into the second frame 92 through an insertion hole (not shown) located substantially at the center of the sensor board 400. This allows the second frame 92 to support the sensor board 400.

As shown in FIG. 3, the sensor board 400 is located downstream of the conveyance roller 23 and the second reconveyance roller 26 and upstream of the registration roller 24 in the conveyance direction D1.

The sensor board 400 has a wiring pattern 400W to which a first sensor 101, a second sensor 201 and a third sensor 301 described later are connected. The wiring pattern 400W is connected to the controller C1 via a connector 400C and a wire harness 400H.

<First Detector, Second Detector and Third Detector>

As schematically shown in FIG. 1, the image forming apparatus 1 includes a first detector 100, a second detector 200 and a third detector 300.

The first detector 100 detects the sheet SH between the conveyance roller 23 and the confluence position J1 in the conveyance path P1. The second detector 200 detects the sheet SH between the second reconveyance roller 26 and the confluence position J1 in the reconveyance path P2. The third detector 300 detects the sheet SH between the registration roller 24 and the image forming unit 3 in the conveyance path P1.

Each of the first detector 100, the second detector 200 and the third detector 300 transmits the detection result to the controller C1. The controller C1 appropriately controls the conveyance timing of each of the sheet SH to be conveyed in the conveyance path P1 and the sheet SH to be conveyed in the reconveyance path P2 based on the detection result.

The configurations of the first detector 100, the second detector 200 and the third detector 300 will be detailed below by referring to FIG. 2 to FIG. 8.

The first detector 100 includes the first sensor 101 shown in FIG. 3, FIG. 4 and FIG. 6, a first actuator 110 shown in FIG. 2 to FIG. 8, and a tension coil spring 150 shown in FIG. 3. The tension coil spring 150 is one example of "first urging member". Alternatively, the first urging member may be a torsion coil spring, a leaf spring, a rubber member, and so on.

Figure 5:
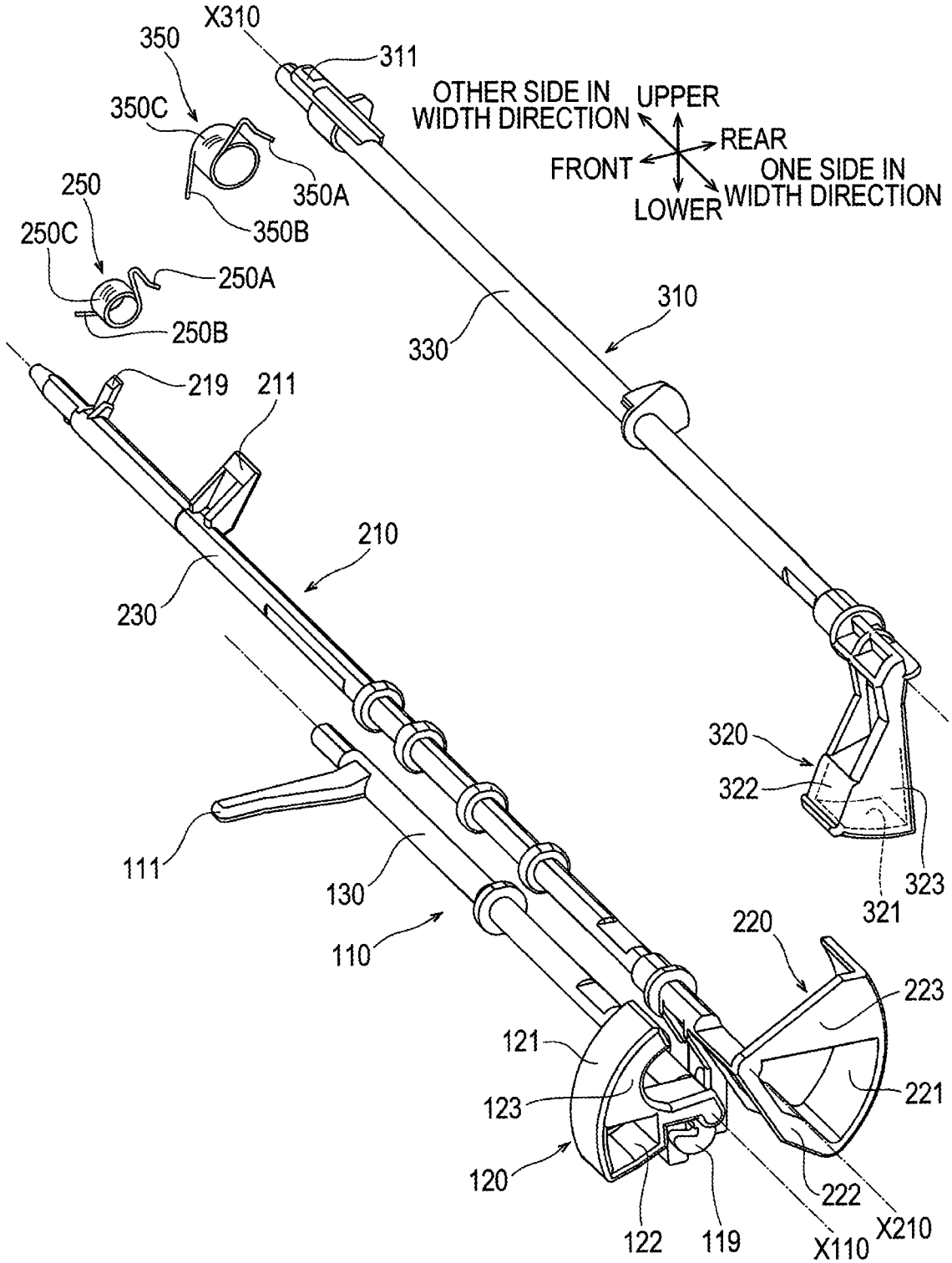
FIG. 5 is a perspective view showing the first to third actuators.

The second detector 200 includes the second sensor 201 shown in FIG. 3, FIG. 4 and FIG. 6, a second actuator 210 shown in FIG. 2 to FIG. 8, and a torsion coil spring 250 shown in FIG. 5. The torsion coil spring 250 is one example of "second urging member". Alternatively, the second urging member may be a tension coil spring, a leaf spring, a rubber member, and so on.

The third detector 300 includes the third detector 301 shown in FIG. 3, FIG. 4 and FIG. 6, a third actuator 310 shown in FIG. 2 to FIG. 6, and a torsion coil spring 350 shown in FIG. 5.

<First Sensor, Second Sensor and Third Sensor>

As shown in FIG. 3, the first sensor 101, the second sensor 201 and the third sensor 301 are photo interrupters which may be the same products. A photo interrupter is a well-known optical sensor configured to detect opening and shutting off in the optical path extending from a light emission part to a light reception part.

The sensor board 400 supports the first sensor 101, the second sensor 201 and the third sensor 301. The first sensor 101 is located at the front lower corner of the sensor board 400. The second sensor 201 is located at the rear lower corner of the sensor board 400. The third sensor 301 is located at the rear upper corner of the sensor board 400.

Each of the first sensor 101, the second sensor 201 and the third sensor 301 has a plurality of terminals connected to the wiring pattern 400W.

The first sensor 101 detects rotational movement of a first co-movement portion 120 described later of the first actuator 110. The second sensor 201 detects rotational movement of a second co-movement portion 220 described later of the second actuator 210. The third sensor 301 detects rotational movement of a third co-movement portion 320 described later of the third actuator 310.

The detection results of the first sensor 101, the second sensor 201 and the third sensor 301 are transmitted to the controller C1 via the wiring pattern 400W, the connector 400C and the wire harness 400H.

<First Actuator and Tension Coil Spring>

As shown in FIG. 5, the first actuator 110 is a resin molded component produced of thermoplastic resin by injection molding and so on. The first actuator 110 has a first rotational shaft 130, a first arm 111, the first co-movement portion 120 and a spring engaging portion 119.

The first rotational shaft 130 has a substantially cylindrical shape extending along a first rotational axis X110 as a center, which extends in the width direction. The first rotational shaft 130 connects the first arm 111, the first co-movement portion 120 and the spring engaging portion 119.

As shown in FIG. 2, the first rotational shaft 130 is supported by the first frame 91. This allows the first rotational shaft 130, the first arm 111, the first co-movement portion 120 and the spring engaging portion 119 to integrally rotationally move about the first rotational axis X110.

As shown in FIG. 2 and FIG. 5, the first arm 111 protrudes from the end part of the other side of the first rotational shaft 130 in the width direction outward in a radial direction of the first rotational axis X110.

As shown in FIG. 3 to FIG. 5, the first co-movement portion 120 and the spring engaging portion 119 extend from an end part of the one side of the first rotational shaft 130 in the width direction outward in different radial directions of the first rotational axis X110.

The first co-movement portion 120 and the spring engaging portion 119 are located at the side of the sensor board 400 in the width direction. In more detail, the first co-movement portion 120 and the spring engaging portion 119 are located at the side opposite to the conveyance path P1 and the reconveyance path P2 with respect to the sensor board 400. In other words, the first co-movement portion 120 is located at the side of the first sensor 101 with respect to the sensor board 400 in the width direction.

As shown in FIG. 3, the spring engaging portion 119 engages one end of the tension coil spring 150 in the state of extending downward. The first frame 91 has a spring engaging portion 91S. The spring engaging portion 91S protrudes rearward from the side surface of the first frame 91 at the one side in the width direction, at a position away from the first rotational axis X110 in the rear lower direction. The spring engaging portion 91S engages the other end of the tension coil spring 150.

The tension coil spring 150 urges the first actuator 110 in the counterclockwise direction in FIG. 3. Accordingly, as shown in FIG. 2, the first arm 111 is held in the state of crossing the conveyance path P1.

The first arm 111 contacts the sheet SH conveyed by the conveyance roller 23, and rotationally moves in the clockwise direction in FIG. 2. That is, the tension coil spring 150 urges the first actuator 110 in the direction opposite to the direction in which the first arm 111 rotationally moves when contacted by the sheet SH.

The shape of the first co-movement portion 120 will be described based on the state where the first arm 111 crosses the conveyance path P1.

As shown in FIG. 5, the first co-movement portion 120 has a first curved part 121, a first connection part 122 and a first reinforcing part 123.

The first curved part 121 has a curved plate shape which extends in an arc shape in the circumferential direction of the first rotational axis X110 and extends in the width direction. As shown in FIG. 3, the upper end of the first curved part 121 is located in the vicinity of the first sensor 101 and at the front of the first sensor 101. The lower end of the first curved part 121 is located at the front and lower side of the first rotational axis X110.

As shown in FIG. 5, the first connection part 122 extends in a radial direction of the first rotational axis X110 and extends in the width direction so as to connect the end part of the first rotational shaft 130 at the one side in the width direction and the lower end of the first curved part 121.

The first reinforcing part 123 reinforces the first curved part 121 by connecting the portion of the edge of the first curved part 121 at the one side in the width direction in the vicinity of the upper end of the first curved part 121 and the edge of the middle portion of the first connection part 122 at the one side in the width direction. The first reinforcing part 123 is recessed forward so as not to contact a second rotational shaft 230 described later of the second actuator 210.

When as shown in FIG. 2 the first arm 111 crosses the conveyance path P1, as shown in FIG. 3 the first curved part 121 of the first co-movement portion 120 opens the optical path of the first sensor 101. Thus, the first sensor 101 detects the absence of the sheet SH between the conveyance roller 23 and the confluence position J1 in the conveyance path P1.

Although not shown in the drawings, when the first arm 111 contacts the sheet SH conveyed by the conveyance roller 23 and rotationally moves in the clockwise direction in FIG. 2, the first co-movement portion 120 also rotationally moves together with the first arm 111, in the clockwise direction in FIG. 3. As a result, the first curved part 121 of the first co-movement portion 120 shuts off the optical path of the first sensor 101. Thus, the first sensor 101 detects the presence of the sheet SH between the conveyance roller 23 and the confluence position J1 in the conveyance path P1.

<Second Actuator and Torsion Coil Spring>

As shown in FIG. 5, the second actuator 210 is a resin molded component produced of thermoplastic resin by injection molding and so on. The second actuator 210 includes the second rotational shaft 230, a second arm 211, the second co-movement portion 220 and a spring engaging portion 219.

The second rotational shaft 230 has a substantially cylindrical shape extending along a second rotational axis X210 as a center which extends in the width direction. The second rotational shaft 230 connects the second arm 211, the second co-movement portion 220 and the spring engaging portion 219.

As shown in FIG. 2, the second rotational shaft 230 is supported by the first frame 91. This allows the second rotational shaft 230, the second arm 211, the second co-movement portion 220 and the spring engaging portion 219 to integrally rotationally move about the second rotational axis X210.

The second rotational shaft 230 is located so as to be slightly shifted to the rear of the position right above the first rotational shaft 130. A range EA1 in which the first rotational shaft 130 exists in the front-rear direction at least partially overlaps with a range EA2 in which the second rotational shaft 230 exists in the front-rear direction.

As shown in FIG. 2 and FIG. 5, the second arm 211 protrudes from the position in the vicinity of the end part of the second rotational shaft 230 at the other side in the width direction outward in a radial direction of the second rotational axis X210.

As shown in FIG. 5, the spring engaging portion 219 extends from the end part of the second rotational shaft 230 at the other side in the width direction outward in a radial direction of the second rotational axis X210.

As shown in FIG. 3 to FIG. 5, the second co-movement portion 220 extends from the end part of the second rotational shaft 230 at the one side in the width direction outward in a radial direction of the second rotational axis X210. In more detail, the second co-movement portion 220 is located at the side opposite to the conveyance path P1 and the reconveyance path P2 with respect to the sensor board 400. In other words, the second co-movement portion 220 is located at the side of the second sensor 201 with respect to the sensor board 400 in the width direction.

As shown in FIG. 5, a coil part 250C of the torsion coil spring 250 is externally fitted to the end part of the second rotational shaft 230 at the other side in the width direction. The spring engaging portion 219 engages one end 250A of the torsion coil spring 250. Although not shown in the drawings, the first frame 91 engages another end 250B of the torsion coil spring 250.

The torsion coil spring 250 urges the second actuator 210 in the clockwise direction in FIG. 2. Accordingly, the second arm 211 is held in the state of crossing the reconveyance path P2.

The second arm 211 contacts the sheet SH conveyed by the second reconveyance roller 26, and rotationally moves in the counterclockwise direction in FIG. 2. That is, the torsion coil spring 250 urges the second actuator 210 in the direction opposite to the direction in which the second arm 211 rotationally moves when contacted by the sheet SH.

The tension coil spring 150 shown in FIG. 3 is located away from the torsion coil spring 250 shown in FIG. 5, in the width direction.

The shape of the second co-movement portion 220 will be described based on the state where the second arm 211 crosses the reconveyance path P2.

As shown in FIG. 5, the second co-movement portion 220 has a second curved part 221, a second connection part 222 and a second reinforcing part 223.

The second curved part 221 has a curved plate shape which extends in an arc shape in the circumferential direction of the second rotational axis X210 and extends in the width direction. As shown in FIG. 3, the upper end of the second curved part 221 is located in the vicinity of the second sensor 201 and also below the second sensor 201. The lower end of the second curved part 221 is located at the rear and lower side of the second rotational axis X210.

As shown in FIG. 5, the second connection part 222 extends in a radial direction of the second rotational axis X210 and extends in the width direction so as to connect the end part of the second rotational shaft 230 at the one side in the width direction and the lower end of the second curved part 221.

The second reinforcing part 223 reinforces the second curved part 221 by connecting the portion of the edge of the second curved part 221 at the one side in the width direction in the vicinity of the upper end of the second curved part 221 and the end part of the second rotational shaft 230 at the one side in the width direction.

When as shown in FIG. 2 the second arm 211 crosses the reconveyance path P2, as shown in FIG. 3 the second curved part 221 of the second co-movement portion 220 opens the optical path of the second sensor 201. Thus, the second sensor 201 detects the absence of the sheet SH between the second reconveyance roller 26 and the confluence position J1 in the reconveyance path P2.

Although not shown in the drawings, when the second arm 211 contacts the sheet SH conveyed by the second reconveyance roller 26 and rotationally moves in the counterclockwise direction in FIG. 2, the second co-movement portion 220 also rotationally moves together with the second arm 211, in the counterclockwise direction in FIG. 3. As a result, the second curved part 221 of the second co-movement portion 220 shuts off the optical path of the second sensor 201. Thus, the second sensor 201 detects the presence of the sheet SH between the second reconveyance roller 26 and the confluence position J1 in the reconveyance path P2.

As shown in FIG. 6, a range EW1 in which the first co-movement portion 120 exists in the width direction at least partially overlaps with a range EW2 in which the second co-movement portion 220 exists in the width direction.

The second co-movement portion 220 is wider than the first co-movement portion 120 at the one side in the width direction. The second co-movement portion 220 is one example of "first particular portion." The first co-movement portion 120 is one example of "second particular portion."

Figure 7:
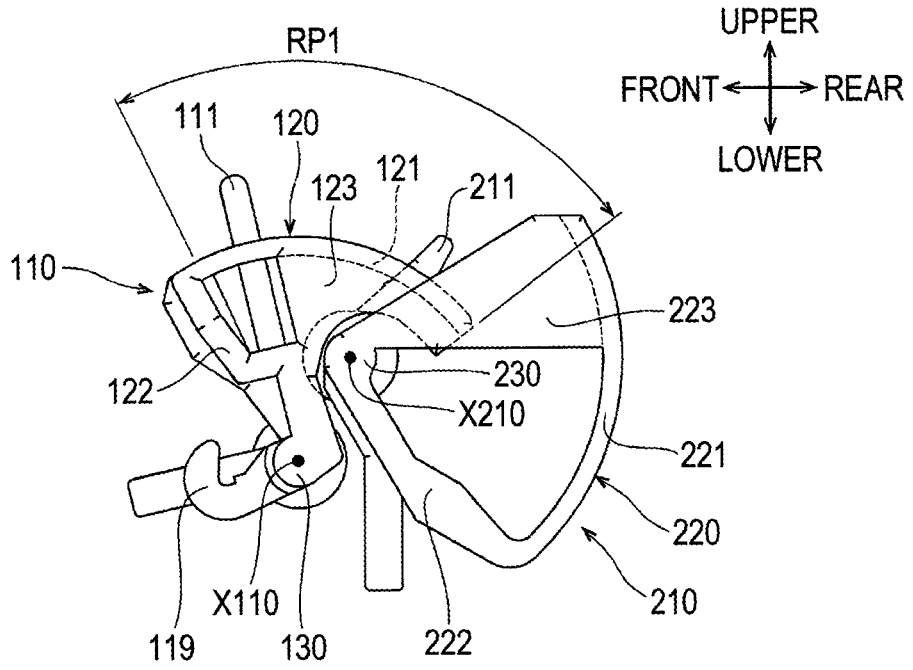
FIG. 7 is a side view showing the first and second actuators, showing a state where the first actuator is rotated.
Figure 8:
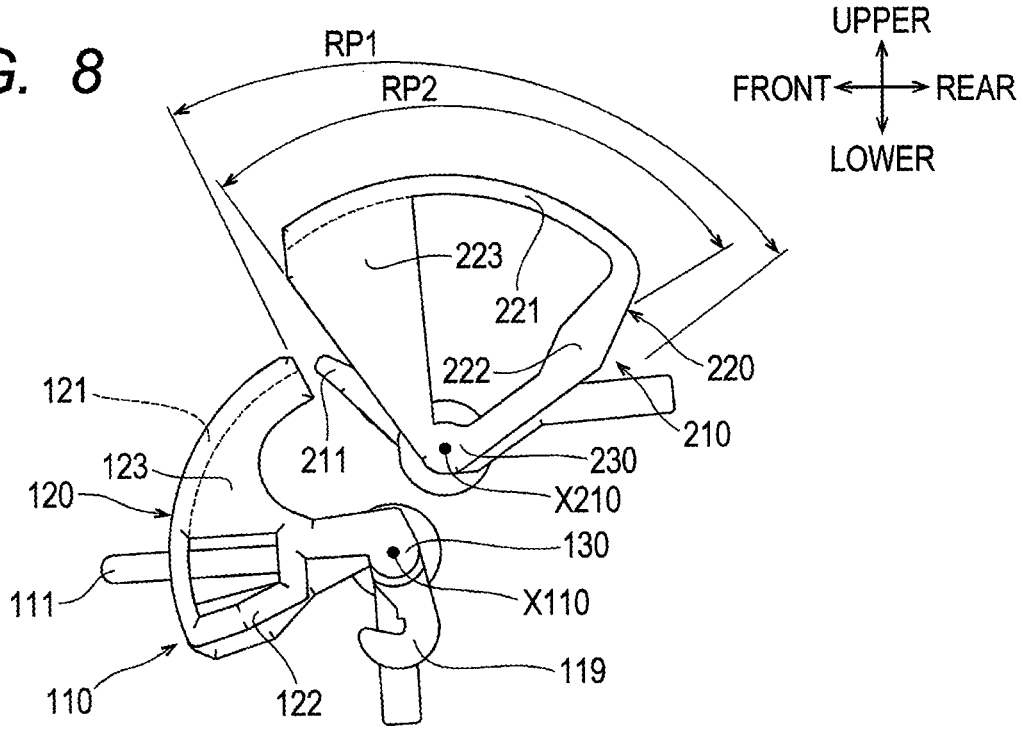
FIG. 8 is a side view similar to FIG. 7, showing a state where the second actuator is rotated.

FIG. 7 and FIG. 8 show a rotation locus RP1 of the first co-movement portion 120 when the first arm 111 rotationally moves when contacted by the sheet SH. FIG. 8 shows a rotation locus RP2 of the second co-movement portion 220 when the second arm 211 rotationally moves when contacted by the sheet SH.

As shown in FIG. 8, the rotation locus RP1 of the first co-movement portion 120 at least partially overlaps with the rotation locus RP2 of the second co-movement portion 220, when viewed from the width direction.

As shown in FIG. 7, the second co-movement portion 220 is formed with the second curved part 221, the second connection part 222 and the second reinforcing part 223 so as to have a hollow shape allowing the first co-movement portion 120 to fit into (enter) the second co-movement portion 220 when the first co-movement portion 120 rotationally moves.

Although not shown in the drawings, the first co-movement portion 120 and the second co-movement portion 220 are formed so as not to interfere with each other even when the first co-movement portion 120 and the second co-movement portion 220 rotationally move simultaneously.

As shown in FIG. 3, the first actuator 110 and the second actuator 210 are located between the conveyance path P1 and the reconveyance path P2. The first actuator 110 is configured to rotationally move in a first rotational direction (clockwise in FIG. 3) when the first arm 111 is contacted by the sheet SH conveyed along the conveyance path P1. The second actuator 210 is configured to rotationally move in a second rotational direction (counterclockwise in FIG. 3) when the second arm 211 is contacted by the sheet SH conveyed along the reconveyance path P2.

<Third Actuator and Torsion Coil Spring>

As shown in FIG. 5, the third actuator 310 is a resin molded component produced of thermoplastic resin by injection molding and so on. The third actuator 310 has a third rotational shaft 330, a third arm 311 and the third co-movement portion 320.

The third rotational shaft 330 has a substantially cylindrical shape extending along a third rotational axis X310 as a center which extends in the width direction. The third rotational shaft 330 connects the third arm 311 and the third co-movement portion 320.

As shown in FIG. 2, the third rotational shaft 330 is supported by the second frame 92. This allows the third rotational shaft 330, the third arm 311 and the third co-movement portion 320 to integrally rotationally move about the third rotational axis X310. The third rotational shaft 330 is separated from and located at an upper and rear side of the second rotational shaft 230.

As shown in FIG. 2 and FIG. 5, the third arm 311 protrudes from the end part of the third rotational shaft 330 at the other side in the width direction outward in a radial direction of the third rotational axis X310.

As shown in FIG. 3 to FIG. 5, the third co-movement portion 320 extends from the end part of the third rotational shaft 330 at the one side in the width direction outward in the radial downward direction of the third rotational axis X310. In more detail, the third co-movement portion 320 is located at the side opposite to the conveyance path P1 and the reconveyance path P2 with respect to the sensor board 400.

As shown in FIG. 5, a coil part 350C of the torsion coil spring 350 is externally fitted to the end part of the third rotational shaft 330 at the other side in the width direction. The third arm 311 engages, at the middle portion thereof, one end 350A of the torsion coil spring 350. Although not shown in the drawings, the second frame 92 engages an other end 350B of the torsion coil spring 350.

The torsion coil spring 350 urges the third actuator 310 in the counterclockwise direction in FIG. 2. Accordingly, the third arm 311 is held in the state of crossing the conveyance path P1.

The third arm 311 contacts the sheet SH conveyed by the registration roller 24, and rotationally moves in the clockwise direction in FIG. 2. That is, the torsion coil spring 350 urges the third actuator 310 in the direction opposite to the direction in which the third arm 311 rotationally moves when contacted by the sheet SH.

The shape of the third co-movement portion 320 will be described based on the state where the third arm 311 crosses the conveyance path P1.

As shown in FIG. 5, the third co-movement portion 320 has a third curved part 321, a third connection part 322 and a third reinforcing part 323.

The third curved part 321 has a curved plate shape which extends in an arc shape in the circumferential direction of the third rotational axis X310 and extends in the width direction. As shown in FIG. 3, the front end of the third curved part 321 is located in the vicinity of the third sensor 301 and also at the front side of the third sensor 301. The rear end of the third curved part 321 is located in the vicinity of the third sensor 301 and also at the rear side of the third sensor 301.

As shown in FIG. 5, the third connection part 322 extends in a radial direction of the third rotational axis X310 and extends in the width direction so as to connect the end part of the third rotational shaft 330 at the one side in the width direction and the front end of the third curved part 321.

The third reinforcing part 323 reinforces the third curved part 321 by connecting the edge of the third curved part 321 at the one side in the width direction and the end part of the third rotational shaft 330 at the one side in the width direction.

When as shown in FIG. 2 the third arm 311 crosses the conveyance path P1, as shown in FIG. 3 the third curved part 321 of the third co-movement portion 320 shuts off the optical path of the third sensor 301. Thus, the third sensor 301 detects the absence of the sheet SH between the registration roller 24 and the image forming unit 3 in the conveyance path P1.

Although not shown in the drawings, when the third arm 311 contacts the sheet SH conveyed by the registration roller 24 and rotationally moves in the clockwise direction in FIG. 2, the third co-movement portion 320 also rotationally moves together with the third arm 311, in the clockwise direction in FIG. 3. As a result, the third curved part 321 of the third co-movement portion 320 opens the optical path of the third sensor 301. Thus, the third sensor 301 detects the presence of the sheet SH between the registration roller 24 and the image forming unit 3 in the conveyance path P1.

<First Guide Rib and Second Guide Rib>

Figure 9:
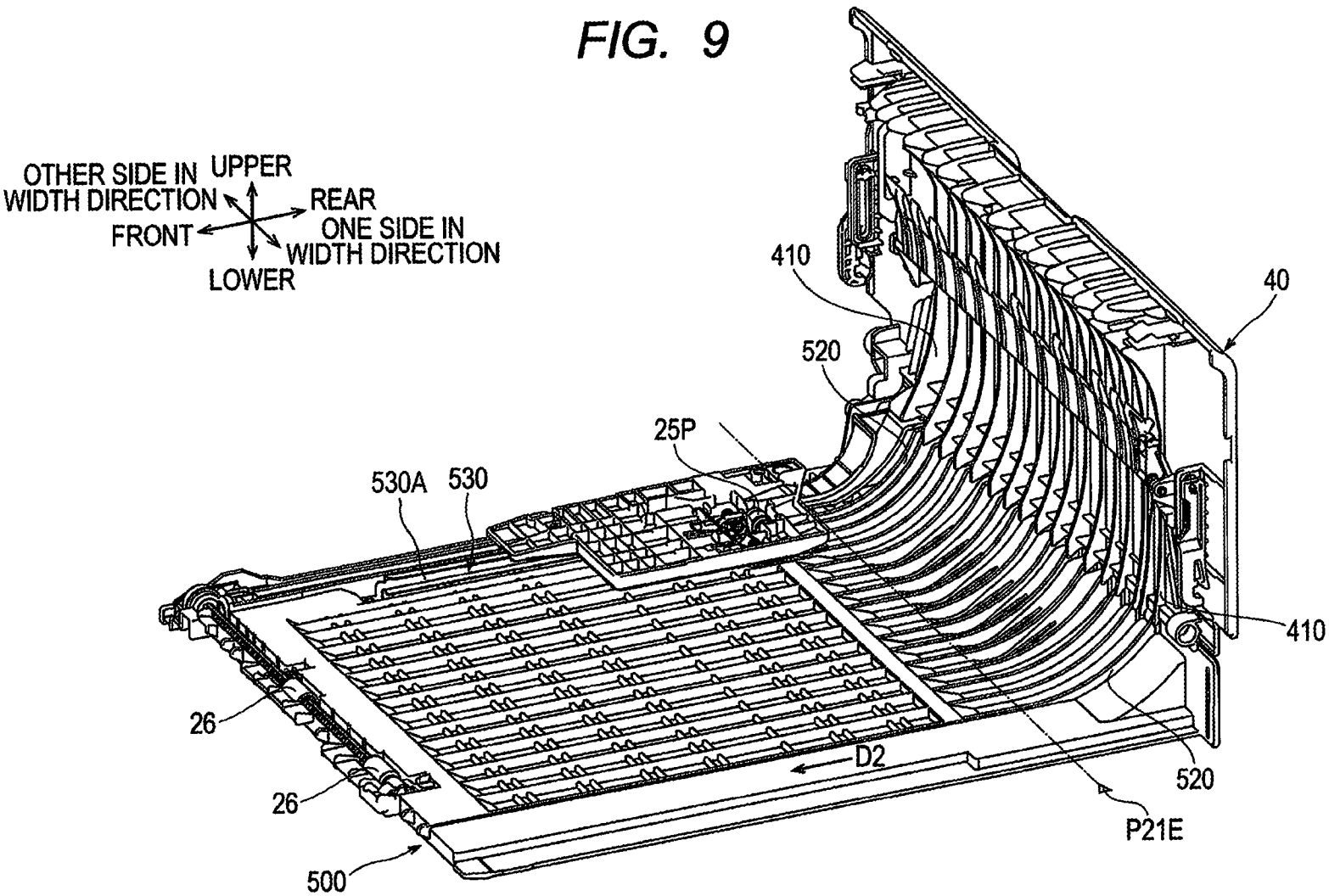
FIG. 9 is a perspective view showing a rear cover and a reconveyance tray.
Figure 10:
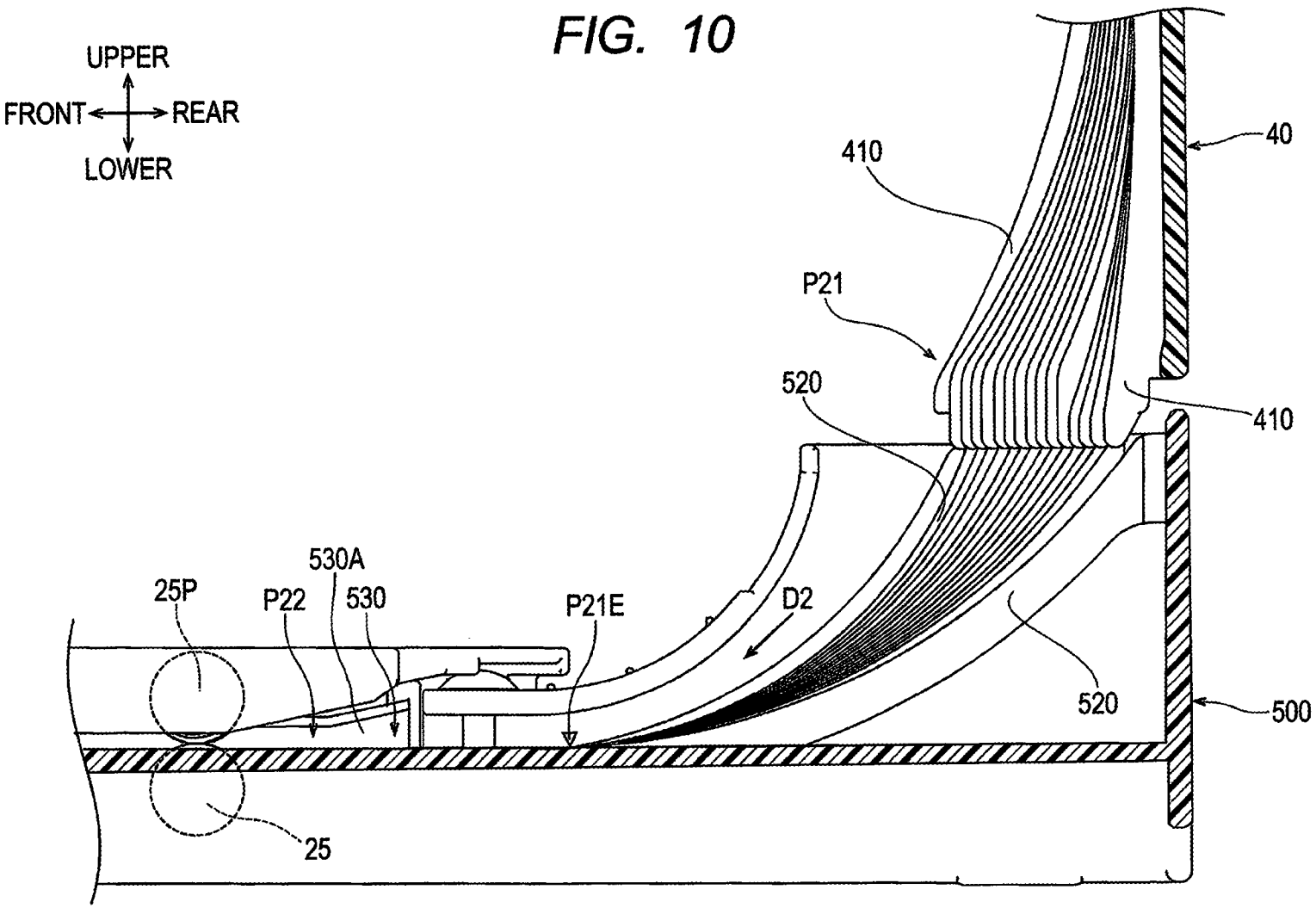
FIG. 10 is a partial cross-sectional view showing the rear cover and the reconveyance tray.

As shown in FIG. 9 and FIG. 10, the rear cover 40 has a plurality of first guide ribs 410. The reconveyance tray 500 has a plurality of second guide ribs 520. The plurality of first guide ribs 410 and the plurality of second guide ribs 520 are provided as examples of "a plurality of guide ribs."

In FIG. 9 and FIG. 10, the first guide rib 410 and the second guide rib 520 located at the end of the one side in the width direction, and the first guide rib 410 and the second guide rib 520 located at the end of the other side in the width direction are denoted by these reference numerals, and the first guide ribs 410 and the second guide ribs 520 located therebetween are shown without these reference numerals.

Each of the first guide ribs 410 is located in the curved section P21 at the upstream side in the reconveyance direction D2.

Each of the first guide ribs 410 protrudes forward from the front surface of the rear cover 40 and extends in the upper-lower direction. The first guide ribs 410 are arranged at intervals in the width direction. Each of the front edges of the first guide ribs 410 is curved so that the middle portion thereof in the upper-lower direction is located at a farther rearward than the upper end and the lower end thereof.

Each of the second guide ribs 520 is located in the curved section P21 at the downstream side of each of the first guide ribs 410 in the reconveyance direction D2, and extends to the downstream end P21E of the curved section P21.

Each of the second guide ribs 520 has a rear portion protruding upward at the rear side of the downstream end P21E of the curved section P21 in the reconveyance tray 500 and which extends in the front-rear direction. The second guide ribs 520 are arranged at intervals in the width direction. Each of the upper edges of the second guide ribs 520 is located at the zero level in height at the downstream end P21E of the curved section P21, and is curved upward in the rear direction so that the inclination angle thereof becomes greater (steeper) gradually.

The first guide ribs 410 and the second guide ribs 520 guide the sheet SH so as to change the reconveyance direction D2 from the downward direction to the horizontal direction toward the confluence position J1.

The first guide ribs 410 and the second guide ribs 520 are configured to be gradually lower in height as separating from the regulating member 530 located at the other side in the width direction on the reconveyance tray 500 to the one side in the width direction.

The first guide ribs 410 are configured so that the lower ends of the front edges thereof are located gradually farther rearward from the regulating member 530 as separating from the regulating member 530 toward the one side in the width direction.

Similarly, the second guide ribs 520 are configured so that the upper ends of the upper edges thereof are located gradually farther rearward from the regulating member 530 as separating from the regulating member 530 toward the one side in the width direction.

Such shapes of the first guide ribs 410 and the second guide ribs 520 produce the larger space allowing deformation of the sheet SH as separating from the regulating member 530 in the width direction.

<Structure for Positioning Transfer Belt>

Figure 11:
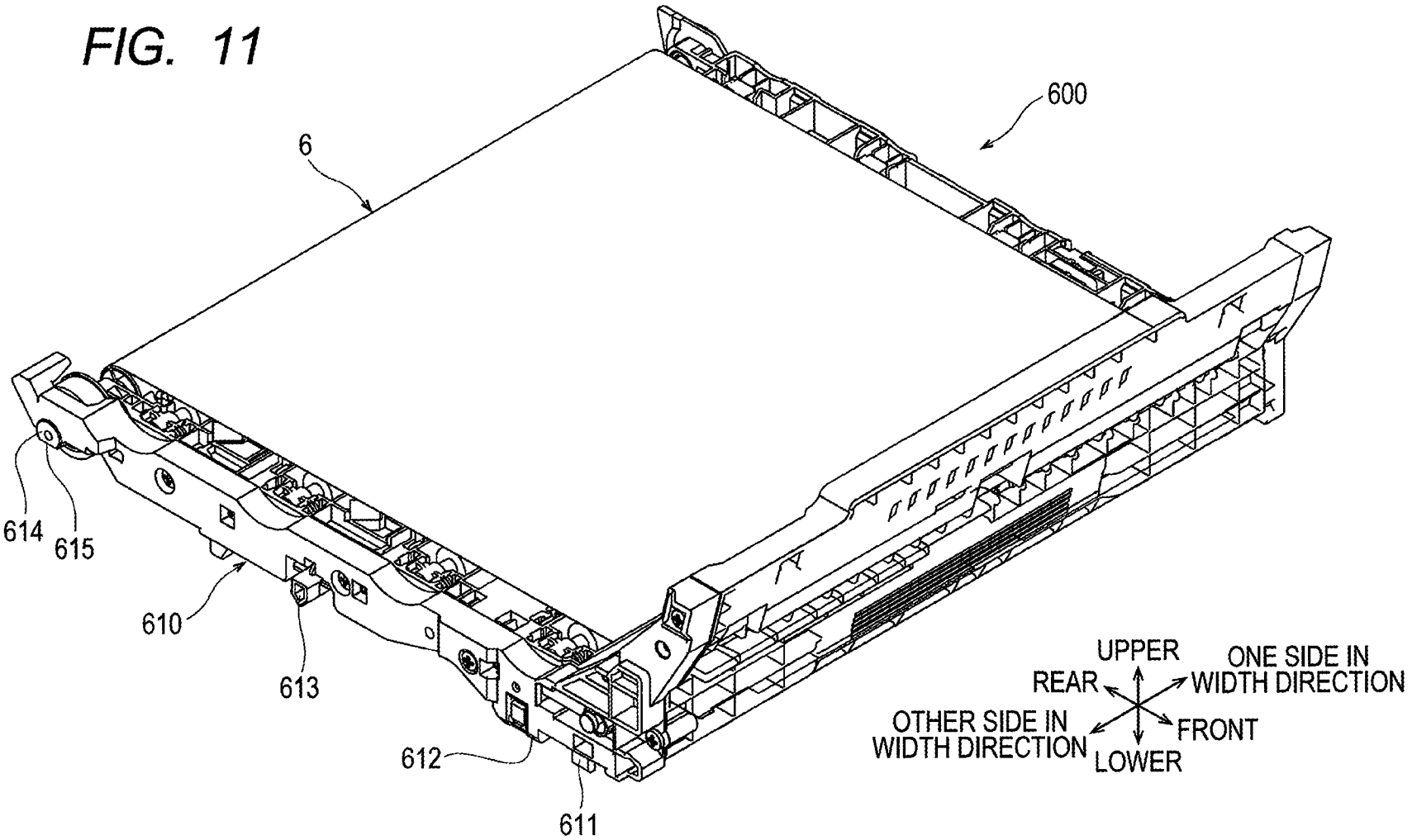
FIG. 11 is a perspective view of a transfer belt unit.
Figure 12:
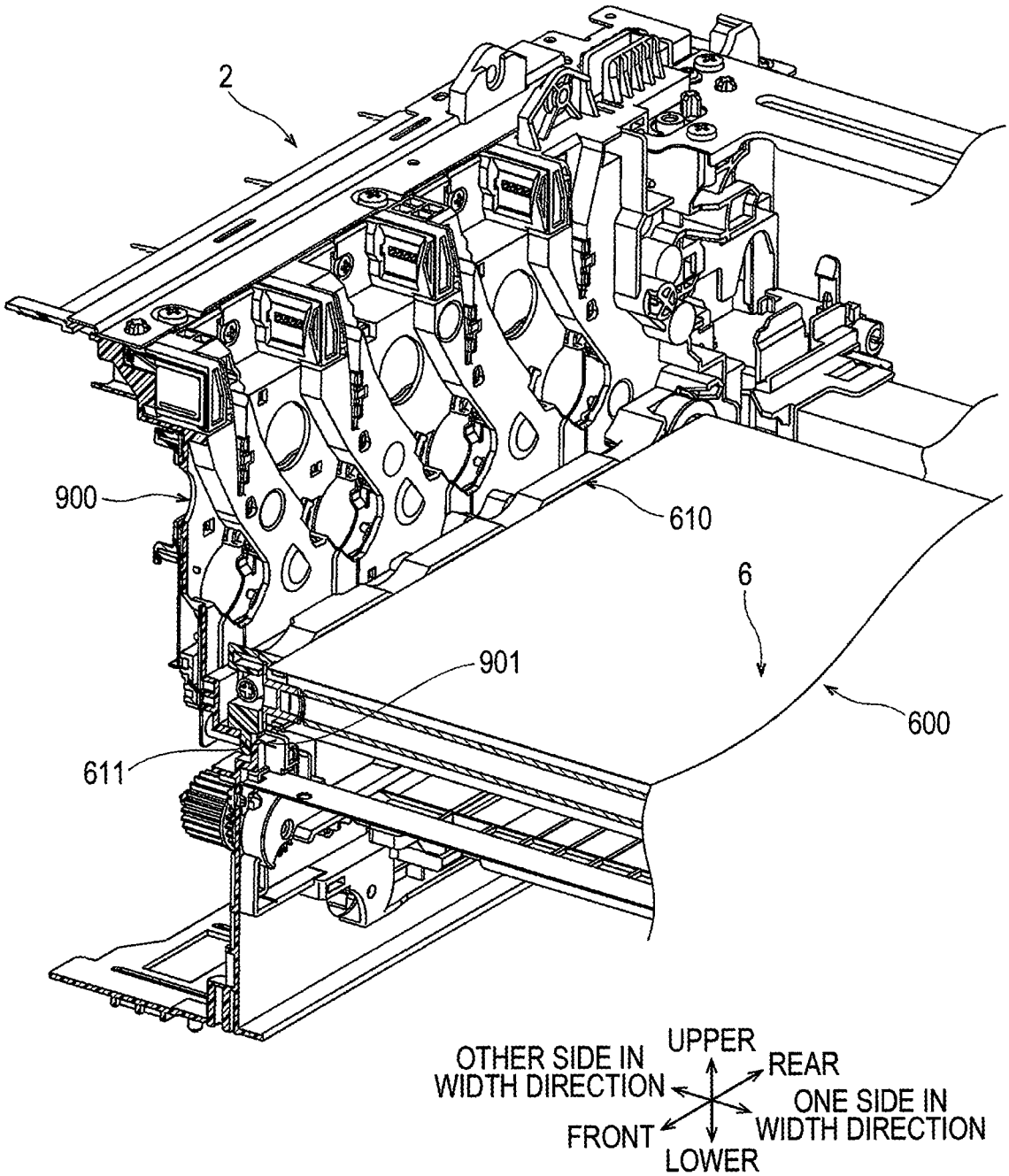
FIG. 12 is a partial perspective view showing a state where the transfer belt unit is positioned at a side frame.

The transfer belt 6 shown in FIG. 1 is configured as a part of a transfer belt unit 600 shown in FIG. 11 and FIG. 12. As shown in FIG. 12, the transfer belt unit 600 is supported in the apparatus main body 2 in a state where the transfer belt unit 600 is positioned by a side frame 900 located at the other side in the width direction and another side frame (not shown) located at the one side in the width direction.

The side frame 900 is a resin molded component produced of thermoplastic resin by injection molding and so on.

Figure 13:
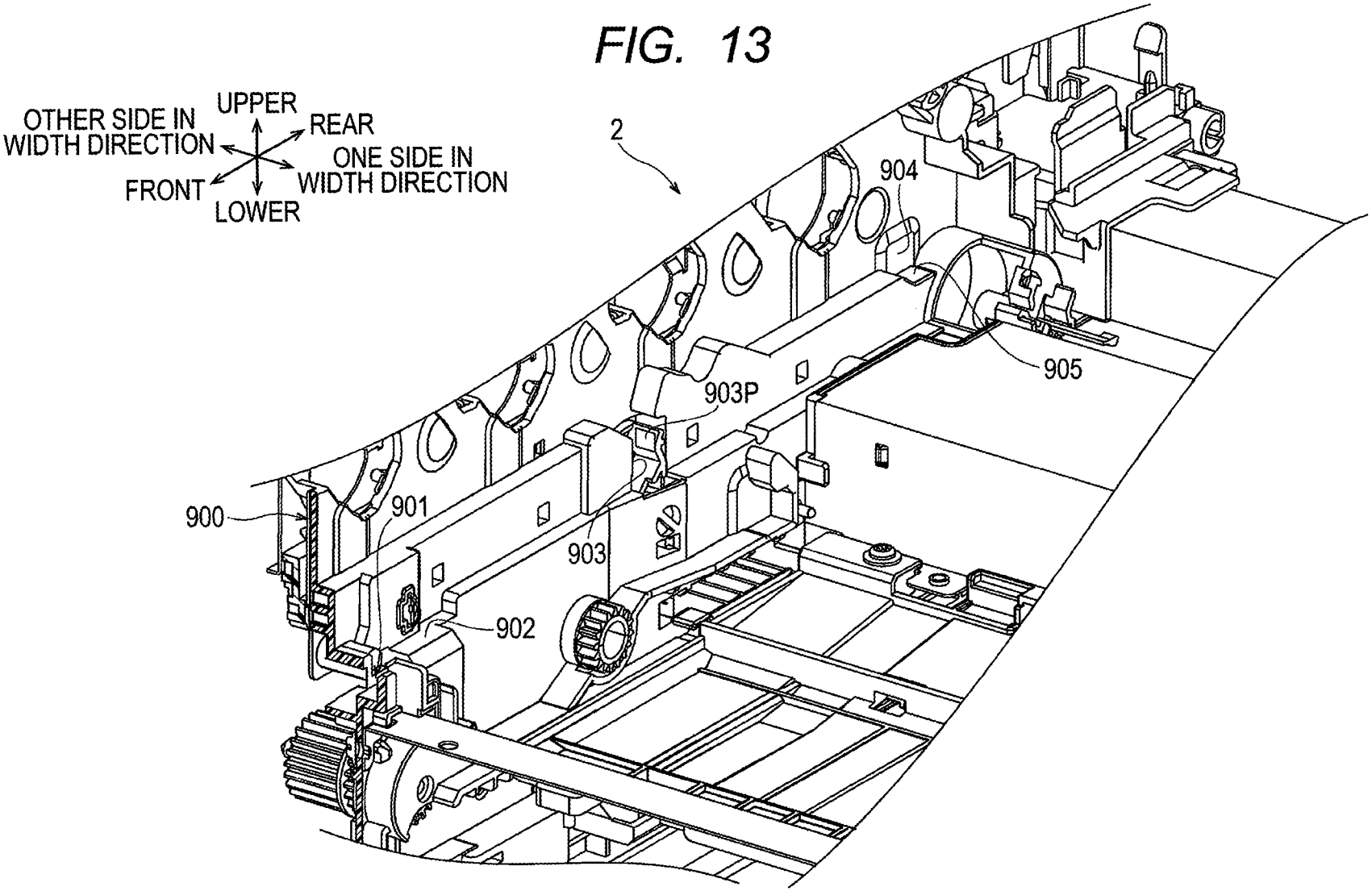
FIG. 13 is a partial perspective view showing a state where the transfer belt unit is removed from the side frame.

As shown in FIG. 13, the transfer belt unit 600 is detachable from the apparatus main body 2. The transfer belt unit 600 includes a unit side frame 610 extending in the front-rear direction, at the other side in the width direction of the transfer belt unit 600.

As shown in FIG. 11, the unit side frame 610 has a first positioning part 611, a second positioning part 612, a third positioning part 613, a fourth positioning part 614 and a fifth positioning part 615.

The first positioning part 611 is a protrusion protruding downward from the front end of the unit side frame 610. As shown in FIG. 12 and FIG. 13, the first positioning part 611 positions the front end of the transfer belt unit 600 in the width direction, by being fitted to a fitting boss 901 formed at the side frame 900.

As shown in FIG. 11, the second positioning part 612 is a flat surface which is located at the rear side of the first positioning part 611 of the unit side frame 610 and faces downward. As shown in FIG. 13, the second positioning part 612 positions the front end of the transfer belt unit 600 in the upper-lower direction by contacting a receiving surface 902 formed at the side frame 900 from above.

As shown in FIG. 11, the third positioning part 613 is a protrusion which protrudes from the middle portion of the unit side frame 610 in the front-rear direction to the other side in the width direction, and the lower part thereof is sharpened. As shown in FIG. 13, the third positioning part 613 positions the transfer belt unit 600 in the front-rear direction by contacting a receiving surface 903 formed at the side frame 900 from the rear and being pressed by a pressing member 903P toward the receiving surface 903.

As shown in FIG. 11, the fourth positioning part 614 is a flat surface which is located at the rear end of the unit side frame 610 and faces toward the other side in the width direction. The fifth positioning part 615 is a flat surface which is located below the fourth positioning part 614 at the rear end of the unit side frame 610 and faces downward.

As shown in FIG. 13, the fourth positioning part 614 positions the rear end of the transfer belt unit 600 in the width direction by being urged by an urging spring (not shown) so as to contact a receiving surface 904 formed at the side frame 900 from the one side in the width direction.

The fifth positioning part 615 positions the rear end of the transfer belt unit 600 in the upper-lower direction by contacting a receiving surface 905 formed at the side frame 900 from above.

The transfer belt unit 600 is positioned by the single side frame 900 in the front-rear direction, the upper-lower direction and the width direction. This suppresses cumulative errors in comparison with the case of positioning by a plurality of components. As a result, the image forming apparatus 1 improves accuracy in positioning of the transfer belt unit 600.

Operations and Effects

As shown in FIG. 3 and FIG. 4, in the image forming apparatus 1, the single sensor board 400 is used as the common board for the first sensor 101 and the second sensor 201. This eliminates the need of separately arranging the sensor board to support the first sensor 101 and the sensor board to support the second sensor 201, and thus eliminates the need of separately ensuring the spaces for the arrangement of those sensor boards.

Accordingly, the image forming apparatus 1 realizes downsizing and reduction of manufacturing cost.

As shown in FIG. 3, in the image forming apparatus 1, the sensor board 400 is located downstream of the conveyance roller 23 and the second reconveyance roller 26 and upstream of the registration roller 24, in the conveyance direction D1. This configuration easily allows to secure free space around the sensor board 400, and the usage of the free space provides higher level of freedom in layout of other components. As a result, the image forming apparatus 1 is manufactured in a further smaller size.

In the image forming apparatus 1, the sensor board 400 is located at the one side in the width direction with respect to the conveyance path P1 and the reconveyance path P2. The first actuator 110 includes the first arm 111 and the first co-movement portion 120. The second actuator 210 includes the second arm 211 and the second co-movement portion 220. The first sensor 101 detects rotational movement of the first co-movement portion 120. The second sensor 201 detects rotational movement of the second co-movement portion 220. This configuration easily allows to arrange the first co-movement portion 120, the second co-movement portion 220, the sensor board 400, the first sensor 101 and the second sensor 201 so as not to interfere with the conveyance path P1 and the reconveyance path P2.

As shown in FIG. 8, in the image forming apparatus 1, the rotation locus RP1 of the first co-movement portion 120 at least partially overlaps with the rotation locus RP2 of the second co-movement portion 220, when viewed from the width direction. This configuration easily allows to arrange the first actuator 110 and the second actuator 210 close to each other in the front-rear direction or the upper-lower direction. As a result, the image forming apparatus 1 is produced in a further smaller size.

As shown in FIG. 6, in the image forming apparatus 1, the range EW1 in which the first co-movement portion 120 exists in the width direction at least partially overlaps with the range EW2 in which the second co-movement portion 220 exists in the width direction. The second co-movement portion 220 is wider than the first co-movement portion 120 at the one side in the width direction. That is, the second co-movement portion 220 protrudes farther toward the one side in the width direction than the first co-movement portion 120. As shown in FIG. 7, the second co-movement portion 220 is formed to have a hollow shape allowing the first co-movement portion 120 to fit into the second co-movement portion 220 when the first co-movement portion 120 rotationally moves. This configuration easily allows to arrange the first actuator 110 and the second actuator 210 further closer to each other in the front-rear direction or the upper-lower direction. As a result, the image forming apparatus 1 is produced in a further smaller size.

As shown in FIG. 2, in the image forming apparatus 1, the range EA1 where the first rotational shaft 130 exists in the front-rear direction at least partially overlaps with the range EA2 where the second rotational shaft 230 exists in the front-rear direction. This configuration easily allows to arrange the first actuator 110 and the second actuator 210 close to each other in the front-rear direction. As a result, the image forming apparatus 1 is produced in a further smaller size.

In the image forming apparatus 1, both the first rotational shaft 130 and the second rotational shaft 230 are supported by the first frame 91. This configuration allows to improve relative positioning accuracy of the first actuator 110 and the second actuator 210.

In the image forming apparatus 1, the second frame 92 supports the sensor board 400. The first frame 91 and the second frame 92 are coupled to each other, and partially define the conveyance path P1 and the reconveyance path P2. With this configuration, the first frame 91 and the second frame 92 are coupled to each other so as to be positioned with high accuracy. This allows to improve relative positioning accuracy of the first actuator 110 and the second actuator 210, and the sensor board 400. As a result, the image forming apparatus 1 allows to improve relative positioning accuracy of the first co-movement portion 120 and the first sensor 101 and of the second co-movement portion 220 and the second sensor 201.

In the image forming apparatus 1, the tension coil spring 150 shown in FIG. 3 is located away from the torsion coil spring 250 shown in FIG. 5, in the width direction. This configuration suppresses the space for the arrangement of the tension coil spring 150 from overlapping with the space for the arrangement of the torsion coil spring 250. As a result, the image forming apparatus 1 is produced in a further smaller size.

The image forming apparatus 1 includes the third detector 300. The sensor board 400 has the wiring pattern 400W to which the third sensor 301 of the third detector 300 is connected, and the sensor board 400 supports the third sensor 301. This configuration allows to use the single sensor board 400 as the common board for the first sensor 101, the second sensor 201 and the third sensor 301. This eliminates the need of separately arranging the sensor board to support the first sensor 101, the sensor board to support the second sensor 201 and the sensor board to support the third sensor 301, and thus eliminates the need of separately ensuring the spaces for the arrangement of those sensor boards. As a result, the image forming apparatus 1 is manufactured in a small size at a low cost.

In the image forming apparatus 1, the reconveyance path P2 passes below the image forming unit 3 and above the sheet tray 2C, and reaches the confluence position J1. This configuration easily allows to arrange the first actuator 110 and the second actuator 210 close to each other, and thus the image forming apparatus 1 is produced in a further smaller size.

As shown in FIG. 9 and FIG. 10, in the image forming apparatus 1, the first guide ribs 410 and the second guide ribs 520 are configured so as to be located gradually lower in height as separating from the regulating member 530 in the width direction. When the sheet SH is aligned in the width direction by the regulating member 530 in the horizontal section P22 while passing through the curved section P21, the sheet SH is easily deformed three-dimensionally, for example, being curved and distorted, and especially tends to be deformed largely in the side away from the regulating member 530 in the width direction. Thus, the above configuration of the first guide ribs 410 and the second guide ribs 520 allows to produce the larger space allowing the deformation of the sheet SH as separating from the regulating member 530 in the width direction. Accordingly, the image forming apparatus 1 allows to suppress excessive conveyance resistance from being generated by the first guide ribs 410 and the second guide ribs 520 against the sheet SH, and as a result allows to suppress unstable behavior of the sheet SH aligned in the width direction by the regulating member 530.

While the disclosure has been described in detail with reference to the above aspects thereof, it would be apparent to those skilled in the art that various changes and modifications may be made therein without departing from the scope of the claims.

This disclosure may be applied to, for example, an image forming apparatus or a multifunction peripheral.

What is claimed is:

1. An image forming apparatus comprising:

an apparatus main body in which a conveyance path and a reconveyance path are formed;

a print engine configured to form an image on a sheet, the conveyance path being a path for conveying a sheet toward the print engine, the reconveyance path being a path for again conveying the sheet on which an image is formed on one surface toward the print engine, the reconveyance path joining the conveyance path at a confluence position;

a first conveyance roller configured to convey the sheet toward the confluence position in the conveyance path;

a second conveyance roller configured to convey the sheet toward the confluence position in the reconveyance path;

a third conveyance roller located between the confluence position and the print engine in the conveyance path, the third conveyance roller being configured to convey the sheet toward the print engine;

a first detector configured to detect the sheet between the first conveyance roller and the confluence position in the conveyance path, the first detector including a first actuator and a first sensor, the first actuator being rotationally movable by contacting the sheet conveyed by the first conveyance roller, the first sensor being an optical sensor configured to detect rotational movement of the first actuator;

a second detector configured to detect the sheet between the second conveyance roller and the confluence position in the reconveyance path, the second detector including a second actuator and a second sensor, the second actuator being rotationally movable by contacting the sheet conveyed by the second conveyance roller, the second sensor being an optical sensor configured to detect rotational movement of the second actuator; and a single sensor board supporting the first sensor and the second sensor, the sensor board having a wiring pattern connected to the first sensor and the second sensor.

2. The image forming apparatus according to claim 1, wherein the sensor board is located downstream of the first conveyance roller and the second conveyance roller and upstream of the third conveyance roller in a conveyance direction of the sheet conveyed along the conveyance path.

3. The image forming apparatus according to claim 1, wherein the sensor board is located at one side of the conveyance path and the reconveyance path in a width direction of the sheet conveyed along the conveyance path and the reconveyance path;

wherein the first actuator is rotationally movable about a first rotational axis extending in the width direction, the first actuator including a first arm and a first co-movement portion, the first arm being rotationally movable by contacting the sheet conveyed by the first conveyance roller, the first co-movement portion being located at a side of the first sensor with respect to the sensor board in the width direction, the first co-movement portion being movable together with the first arm;

wherein the second actuator is rotationally movable about a second rotational axis extending in the width direction, the second actuator including a second arm and a second co-movement portion, the second arm being rotationally movable by contacting the sheet conveyed by the second conveyance roller, the second co-movement portion being located at a side of the second sensor with respect to the sensor board in the width direction, the second co-movement portion being movable together with the second arm;

wherein the first sensor is configured to detect rotational movement of the first co-movement portion; and wherein the second sensor is configured to detect rotational movement of the second co-movement portion.

4. The image forming apparatus according to claim 3, wherein a rotation locus of the first co-movement portion at least partially overlaps a rotation locus of the second co-movement portion as viewed from the width direction.

5. The image forming apparatus according to claim 4, wherein a range in which the first co-movement portion exists in the width direction at least partially overlaps a range in which the second co-movement portion exists in the width direction;

wherein a first particular portion which is one of the first co-movement portion and the second co-movement portion protrudes farther toward the one side in the width direction than a second particular portion which is an other one of the first co-movement portion and the second co-movement portion; and wherein the first particular portion has a hollow shape such that the second particular portion fits into the first particular portion when the second particular portion rotational moves.

6. The image forming apparatus according to claim 3, wherein the first actuator includes a first rotational shaft extending along the first rotational axis and connecting the first arm with the first co-movement portion;

wherein the second actuator includes second rotational shaft extending along the second rotational axis and connecting the second arm with the second co-movement portion; and wherein a first range in which the first rotational shaft exists in a front-rear direction at least partially overlaps a second range in which the second rotational shaft exists in the front-rear direction, the front-rear direction being perpendicular to both the width direction and a vertical direction.

7. The image forming apparatus according to claim 3, further comprising a first frame;

wherein the first actuator includes a first rotational shaft extending along the first rotational axis and connecting the first arm with the first co-movement portion;

wherein the second actuator includes second rotational shaft extending along the second rotational axis and connecting the second arm with the second co-movement portion; and wherein both the first rotational shaft and the second rotational shaft are supported by the first frame.

8. The image forming apparatus according to claim 7, further comprising a second frame supporting the sensor board, wherein the first frame and the second frame are coupled to each other and define a part of the conveyance path and a part of the reconveyance path.

9. The image forming apparatus according to claim 1, wherein the first detector includes a first urging member configured to urge the first actuator in a direction opposite to a direction in which the first actuator rotationally moves when contacted by the sheet;

wherein the second detector includes a second urging member configured to urge the second actuator in a direction opposite to a direction in which the second actuator rotationally moves when contacted by the sheet; and wherein the first urging member and the second urging member are located at positions away from each other in a width direction of the sheet conveyed along the conveyance path and the reconveyance path.

10. The image forming apparatus according to claim 9, wherein the first urging member is a tension coil spring.

11. The image forming apparatus according to claim 9, wherein the second urging member is a torsion coil spring.

12. The image forming apparatus according to claim 1, further comprising a third detector configured to detect the sheet between the third conveyance roller and the print engine in the conveyance path, the third detector including a third actuator and a third sensor, the third actuator being configured to rotationally move when contacted by the sheet conveyed by the third conveyance roller, the third sensor being an optical sensor configured to detect rotational movement of the third actuator, wherein the sensor board supports the third sensor, the wiring pattern being connected to the third sensor.

13. The image forming apparatus according to claim 1, further comprising a sheet tray located below the print engine, the sheet tray being configured to accommodate the sheet before being conveyed by the first conveyance roller, wherein the reconveyance path passes below the print engine and above the sheet tray and reaches the confluence position.

14. The image forming apparatus according to claim 1, wherein the reconveyance path includes:

a curved section in which a reconveyance direction of the sheet conveyed along the reconveyance path changes from a downward direction to a horizontal direction toward the confluence position; and a horizontal section connected to a downstream end of the curved section in the reconveyance direction, the horizontal section being a section in which the reconveyance direction is a horizontal direction toward the confluence position;

wherein the image forming apparatus further includes:

a plurality of guide ribs located at the curved section, the plurality of guide ribs being arranged at intervals in a width direction of the sheet conveyed along the conveyance path and the reconveyance path, the plurality of guide ribs being configured to guide the sheet such that the reconveyance direction changes from the downward direction to the horizontal direction toward the confluence position; and a regulating surface located at the horizontal section, the regulating surface being configured to position the sheet with respect to the width direction; and wherein the plurality of guide ribs is configured to be gradually lower in height as separating from the regulating surface in the width direction.

15. The image forming apparatus according to claim 1, wherein the first co-movement portion includes a first curved part having a curved plate shape which extends in an arc shape in a circumferential direction of the first rotational axis;

wherein the first curved part opens or shuts off an optical path of the first sensor depending on whether the first arm crosses the conveyance path or the first arm does not cross the conveyance path by being contacted by the sheet, thereby the first sensor detects presence or absence of the sheet between the first conveyance roller and the confluence position in the conveyance path;

wherein the second co-movement portion includes a second curved part having a curved plate shape which extends in an arc shape in a circumferential direction of the second rotational axis; and wherein the second curved part opens or shuts off an optical path of the second sensor depending on whether the second arm crosses the reconveyance path or the second arm does not cross the reconveyance path by being contacted by the sheet, thereby the second sensor detects presence or absence of the sheet between the second conveyance roller and the confluence position in the reconveyance path.

16. The image forming apparatus according to claim 1, wherein the first actuator and the second actuator are located between the conveyance path and the reconveyance path;

wherein the first actuator is configured to rotationally move in a first rotational direction when the first arm is contacted by the sheet conveyed along the conveyance path; and wherein the second actuator is configured to rotationally move in a second rotational direction when the second arm is contacted by the sheet conveyed along the reconveyance path, the second rotational direction being opposite to the first rotational direction.

* * * * *